US011640142B2

(12) United States Patent
Delizee et al.

(10) Patent No.: US 11,640,142 B2
(45) Date of Patent: May 2, 2023

(54) STRIKING OR MUSICAL WATCH PROVIDED WITH AT LEAST ONE ACOUSTIC RADIATING MEMBRANE AND METHOD FOR MANUFACTURING THE MEMBRANE

(71) Applicant: Blancpain SA, Le Brassus (CH)

(72) Inventors: Alain Delizee, Les Bioux (CH); Mehdi Denden, Les Rousses (FR); Jerome Favre, Neuchatel (CH)

(73) Assignee: Blancpain SA, Le Brassus (CH)

( * ) Notice: Subject to any disclaimer, the term of this patent is extended or adjusted under 35 U.S.C. 154(b) by 874 days.

(21) Appl. No.: 16/598,258

(22) Filed: Oct. 10, 2019

(65) Prior Publication Data

US 2020/0133202 A1 Apr. 30, 2020

(30) Foreign Application Priority Data

Oct. 26, 2018 (EP) ..... 18202869

(51) Int. Cl.
*G04B 21/08* (2006.01)
*G04B 21/06* (2006.01)
*G04B 39/00* (2006.01)

(52) U.S. Cl.
CPC ..... *G04B 21/08* (2013.01); *G04B 21/06* (2013.01); *G04B 39/00* (2013.01)

(58) Field of Classification Search
CPC ..... G04B 21/08; G04B 21/06; G04B 21/02; G04B 39/00
See application file for complete search history.

(56) References Cited

U.S. PATENT DOCUMENTS 5,932,360 A 8/1999 Hazlitt et al.
8,770,833 B2 * 7/2014 Sciascia ..... G04B 21/08 368/315

(Continued)

FOREIGN PATENT DOCUMENTS

CH 708 111 B1 12/2014
CN 101036088 A 9/2007

(Continued)

OTHER PUBLICATIONS

First Office Action dated Dec. 16, 2020 in Chinese Patent Application No. 201911014845.5 (with English translation and English translation of Categories of Cited Documents), 18 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A striking watch is provided with an acoustic radiating membrane made of metallic material or amorphous metal. The membrane takes the form of a loop with walls of a certain thickness to be connected by a first edge portion to a middle part of a watch case and by a second edge portion to a bezel fixed to a watch crystal. The bezel connected to crystal is movable with respect to the case middle via the membrane during the vibration of membrane once a sound is generated by a watch striking mechanism in the watch case. The membrane is configured with a wall of a specific thickness in an active region dependent on the mass of the bezel connected to the crystal, to obtain a frequency $f_0$ of a first vibration mode.

17 Claims, 2 Drawing Sheets

(56) References Cited

U.S. PATENT DOCUMENTS

| | | | | |
|---|---|---|---|---|
| 8,876,371 | B2 * | 11/2014 | Behrend | G04G 17/08 368/286 |
| 11,320,788 | B2 * | 5/2022 | Stranczl | G04B 37/0075 |
| 2012/0002513 | A1 | 1/2012 | Behrend et al. | |
| 2015/0160618 | A1 * | 6/2015 | Karapatis | G04B 37/0075 368/272 |
| 2016/0109855 | A1 * | 4/2016 | Kadmiri | G04B 37/087 368/294 |

FOREIGN PATENT DOCUMENTS

| | | | |
|---|---|---|---|
| CN | 102193490 | A | 9/2011 |
| CN | 102356362 | A | 2/2012 |
| CN | 107193199 | A | 9/2017 |
| EA | 2 738 625 | B1 | 8/2015 |
| EP | 0 028 429 | A1 | 5/1981 |
| JP | 54-8974 | U | 1/1979 |
| JP | 55-139479 | U | 10/1980 |
| JP | 5717341 | Y2 | 4/1982 |
| JP | 6142151 | Y2 | 11/1986 |
| JP | 8-179061 | A | 7/1996 |
| WO | WO 2006/137478 | A1 | 12/2006 |

OTHER PUBLICATIONS

European Search Report dated Apr. 30, 2019 in European Application 18202869.6 filed on Oct. 26, 2018 (with English Translation of Categories of Cited Documents)

* cited by examiner

STRIKING OR MUSICAL WATCH PROVIDED WITH AT LEAST ONE ACOUSTIC RADIATING MEMBRANE AND METHOD FOR MANUFACTURING THE MEMBRANE

CROSS-REFERENCE TO RELATED APPLICATION

This application claims priority to European Patent Application No. 18202869.6 filed on Oct. 26, 2018, the entire disclosure of which is hereby incorporated herein by reference.

FIELD OF THE INVENTION

The invention concerns a striking or musical watch provided with an acoustic radiating membrane. The watch comprises, in particular, a watch case with a back cover and a case middle, closed by a crystal to display time information on a dial underneath the crystal. The watch also contains, inside the watch case, a striking mechanism for generating a sound or piece of music at predefined moments or on demand.

The invention also concerns a method for making an acoustic radiating membrane for a striking or musical watch.

STATE OF THE ART

It is known to provide a watch with a striking mechanism to generate a sound or piece of music. To this end, a gong of the striking watch or a vibration plate of the musical watch are arranged inside the watch case. Thus, the vibrations of the gong or the vibration plate strips are transmitted to the various external parts. These external parts are, in particular, the case middle, the bezel, the crystal and the back cover of the watch case. These large external parts start to radiate sound into the air under the effect of the transmitted vibrations. When a sound is produced either by a gong struck by a hammer, or by one or more vibrating strips of the vibration plate, these external parts are capable of radiating the produced sound into the air.

However, in a conventional musical or striking watch, the acoustic performance, based on the complex vibro-acoustic transduction of the external parts, is poor. In order to improve and increase the acoustic level of a sound or a note, the geometry and boundary conditions of the external parts must be considered. The configuration of the external parts is also dependent on the aesthetics of the watch and operating constraints, which may limit possibilities of adaptation.

Thus, in order to further improve the vibro-acoustic performance of the striking mechanism, one or more membranes are arranged to be placed inside the watch case. The membranes are designed and configured such that the note or notes produced in the watch case are radiated effectively. The frequencies of the notes generated must be close to the natural vibration modes of the membrane or membranes so that they come into resonance.

European Patent Application No. EP 0 028 429 A1 discloses a watch with an electroacoustic alarm device. This device is intended to improve acoustic performance and sound quality. The watch crystal is retained on the case middle by a support ring. This support ring is an annular vibrating membrane. Between two edges of the membrane, there is a curved central area. A central arbor is secured to the crystal and activated by an excitation electromagnet for vibration. The membrane can be obtained by electroforming. A sound is generated by the action of an electronic device excited by an alternating current, which does not provide the same quality as a sound generated by a striking mechanism using mechanical action, which constitutes a drawback.

European Patent Nos. EP 2 409 200 B1 and EP 2 738 625 B1 disclose a watch case with a case middle closed, on one side, by a bezel and a crystal, and on another side by a case back. The bezel and crystal are connected by a resilient annular metal member shaped like bellows with at least one annular fold with a curvature of between 90° and 180° to give the bezel and the crystal connected to the bellows a freedom of movement perpendicularly or parallel to a dial. However, these Patents emphasise the particular shape of the membrane while using it to provide a freedom of movement to the bezel and not as a radiating element for a striking mechanism. The natural oscillation frequency of the assembly formed of the crystal and the metal member is higher than the frequency band of the transmitted signal to avoid any degradation or distortion of the sound, which does not effectively radiate the sound produced. This thus constitutes a drawback.

SUMMARY OF THE INVENTION

It is therefore an object of the invention to overcome the drawbacks of the prior art by providing a striking or musical watch provided with at least one acoustic radiating membrane arranged to produce a rich sound with better acoustic radiation of low frequency vibrations via the membrane connected to a crystal or a bezel connected to a crystal of the watch case.

The invention therefore concerns the aforecited striking or musical watch, which includes the features defined in the independent claim 1.

Specific embodiments of the striking or musical watch are defined in the dependent claims 2 to 13.

One advantage of the striking or musical watch lies in the fact that the membrane is configured such that, when excited by the generation of a sound from at least one gong or one strip of a vibration plate, there is a transverse wave transmission. The thin membrane connects, on one hand, a bezel secured to a crystal or directly a watch crystal, and on the other hand, a watch case middle. Thus, the bezel and crystal together, or simply the crystal, become mobile and vibrate at the same vibration modes as the membrane to obtain vibration modes of less than 4 kHz, or 1 kHz or less, depending on the thickness of the membrane and/or also its curvature. The membrane acts as a spring in relation to the bezel/crystal or to the crystal which forms the mass. The frequency of the first vibration mode depends on the square root of stiffness over mass. This first vibration mode is of the piston type. Thus, the lower the stiffness of the membrane, the lower the frequency of the first vibration mode, which is desired.

Advantageously, the membrane can be made by an electroforming process. It can be made with a thickness of less than 80 μm, for example, as low as 37 μm, which makes it possible to reduce the radiation frequency to 500 Hz while still offering good acoustic radiation up to frequencies of around 8 to 10 kHz. By working at such low frequencies, it is possible to obtain a warmer, louder sound, since the more radiated modes there are, the more the human ear interprets this as a loud sound, and a more distinct sound when music is produced.

The membrane can be made from a metal material, such as 5N gold.

To this end, the invention also concerns a method for manufacturing at least one acoustic radiating membrane for a striking or musical watch, which includes the features defined in the independent claims 14 and 15.

One particular manufacturing step is defined in the dependent claim 16.

BRIEF DESCRIPTION OF THE DRAWINGS

The objects, advantages and features of a striking or musical watch provided with at least one acoustic radiating membrane and the method for manufacturing the membrane will appear more clearly in the following description, particularly with reference to the drawings, in which.

DETAILED DESCRIPTION OF THE INVENTION

In the following description, all the parts of a watch striking mechanism provided with an acoustic radiating membrane that are well known in this technical field will be described only briefly. The focus is mainly on the arrangement of the membrane inside the watch case and on its configuration to allow adequate acoustic radiation following the generation of a sound inside the watch case.

Figure 1:
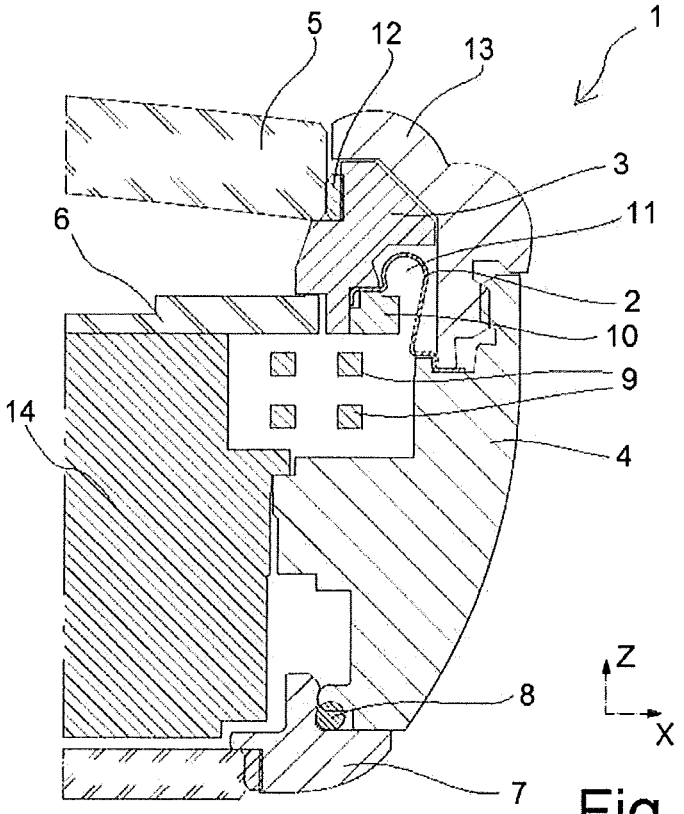
FIG. 1 represents a partial cross-sectional view of a striking or musical watch having a membrane in the vicinity of the crystal and middle part of a watch case according to a first embodiment of the invention.

FIG. 1 thus represents a first embodiment of a mechanical striking or musical watch 1, which includes at least one acoustic radiating membrane 2. This acoustic radiating membrane 2 is made of metallic material or amorphous metal and is a connecting piece in the form of a loop with walls of a certain thickness. It can be considered to be a membrane spring. This membrane 2 is arranged to be connected by a first edge portion 23 to a middle part 4 of a watch case, particularly on the upper part of case middle 4, and by a second edge portion 20 to a bezel 3 fixed to watch crystal 5 via a gasket 12. According to a variant, second edge portion 20 of membrane 2 can also be directly connected to a watch crystal 5.

It is to be noted that the first edge portion 23 of membrane 2 can be secured to the upper part of case middle 4, particularly inside an annular groove via a complementary bezel 13. This complementary bezel can be screwed onto the upper part of case middle 4 or secured by adhesive bonding or welding or brazing or pressed thereon so that the lower portion of complementary bezel 13 secures the first edge portion inside the annular groove of case middle 4. Complementary bezel 13 can also serve as protection for the assembly comprising bezel 3 connected to crystal 5 and to membrane 2.

In FIG. 1, striking or musical watch 1 also includes a striking mechanism represented simply by a certain number of gongs 9 disposed, in this configuration, underneath watch dial 6. The striking mechanism is connected to a timepiece movement 14 disposed between dial 6 and a back cover 7, which is secured to a lower part of case middle 4 by a sealing gasket 8. These gongs 9, which are spaced apart from one another, can each be struck by a particular hammer (not represented) normally at determined times in order to each generate a different sound and which can also generate a tune. It is also possible to provide a vibration plate with strips of different lengths (not represented) to be activated by a disc or cylinder with members for actuating the strips in order to generate music according to the arrangement of the actuation members.

Membrane 2, as represented in FIGS. 1 to 4, is of annular shape with an arcuate or curved part, which points towards watch crystal 5 in an active region 11 of membrane 2 in a direction Z perpendicular to the plane of the watch. The arcuate part is a portion of a circle in cross-section as shown, which is extended by a straight part, defining a frustoconical portion up to first edge portion 23. According to this first embodiment, the second edge portion 20 of membrane 2 is secured by a retaining ring 10, which is pressed, for example, onto a cylindrical external wall of the bottom of bezel 3. An internal annular groove can be provided in the retaining ring, used to guide an internal fold of second edge portion 20 of membrane 2. Further, this securing ring 10 can be welded or soldered to the bottom part of bezel 3 to ensure a good seal of the assembly of membrane 2 and bezel 3.

Bezel 3 also includes an upper edge, where watch crystal 5 lies, secured by gasket 12 to an upper internal wall of bezel 3. A lower internal edge of bezel 3 lies above dial 6 without touching it to allow mobility of bezel 3 and crystal 5 which are retained by membrane 2. A space of between 70 and 100 μm is provided between bezel 3 and dial 6, or between bezel 3 and complementary bezel 13, to allow mobility of the membrane 2/bezel 3 assembly. As desired, bezel 3 connected to crystal 5, or crystal 5, is movable with respect to case middle 4 by means of membrane 2 during the vibration of membrane 2 after a sound is generated by the watch striking mechanism in the watch case. Bezel 3 connected to membrane 2 vibrates at the same vibration modes as membrane 2, which are considerably lower than the vibration modes of conventional external watch parts.

It is to be noted that, once the annular membrane is secured to bezel 3 connected to crystal 5 or simply to crystal 5, and to case middle 4, the inside of the striking or musical watch case is sealed while allowing freedom of movement to bezel 3 connected to membrane 2 or to crystal 5 connected to membrane 2.

The membrane is configured with a wall of a specific thickness, dependent on the mass of bezel 3 connected to crystal 5, or only of crystal 5, to obtain a low frequency $f_0$ of the first vibration mode. It is desired to have a low frequency of less than or equal to 4 kHz and preferably less than or equal to 1 kHz. To this end, account is taken of the equation $f_0=(1/2\pi)\cdot(k/m)^{1/2}$ where k is the stiffness of membrane 2, which depends on the thickness thereof, and m is the mass of bezel 3 connected to crystal 5, or simply of crystal 5. It is thus possible to lower the resonance frequency of membrane 2 connected to bezel 3 by increasing the mass m of bezel 3 connected to crystal 5. However, it is preferable to reduce the thickness of membrane spring 2 to decrease first vibration mode frequency $f_0$ by reducing the stiffness k of membrane 2. Excitation of membrane 2 thus occurs by transmitting transverse waves generated by the vibration of one or more gongs 9 disposed underneath the dial in this first embodiment.

This membrane 2 connected to bezel 3 with crystal 5, or connected only to crystal 5, can cover an acoustic radiation band from 1 kHz to 10 kHz with the external watch parts. If the thickness of membrane 2 is reduced to decrease its stiffness following an electroforming manufacturing process explained below, the acoustic radiation band may even lie between 500 Hz and 10 kHz.

By way of non-limiting example, it is possible to have a sapphire crystal 5 with a thickness of 2 mm and a diameter on the order of 37.8 mm with a bezel 3 made of metal, such as gold, in order to have a mass on the order of 13 grams. Bezel 3 is annular in shape with an inner diameter on the order of 36 mm and an external diameter on the order of 41.9 mm, and a thickness on the order of 3.55 mm. Membrane 2, which can be electroformed, as explained below with reference to FIGS. 4*a* to 4*e*, can preferably be made of 5N gold to match the desired resonance frequency, since most of the external parts are also made of gold. Active region 11 of the membrane can be a space between bezel 3 and complementary bezel 13 which is 1.2 mm wide by 2 mm high in direction Z.

Figure 2A:
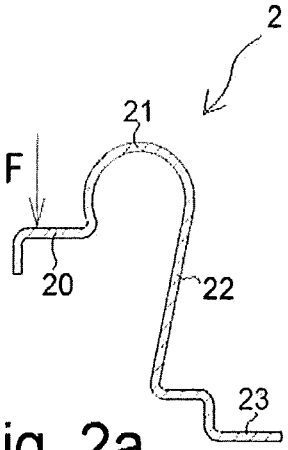
FIGS. 2*a* to 2*c* represent several embodiments of the annular membrane, of which a cross-section of one side is shown, according to the invention.
Figure 2B:
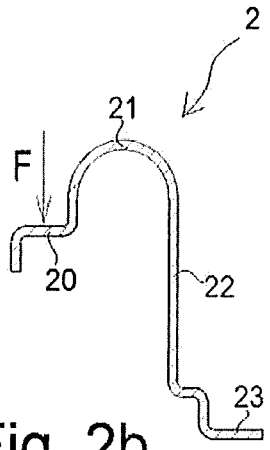
Figure 2C:
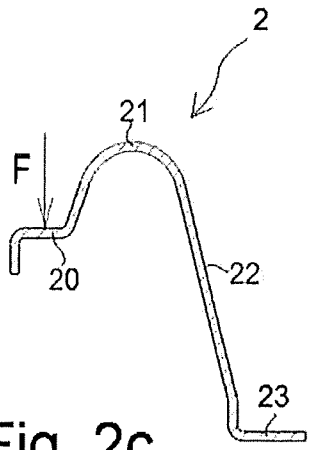

FIGS. 2*a* to 2*c* represent several embodiments of the annular membrane, of which a cross-section of one side is shown, according to the invention. In FIG. 2*a*, membrane 2 has an arcuate part 21, wherein the angle of the portion of a circle is greater than 180° from second edge portion 20 to a straight part 22 that connects to first edge portion 23. In FIG. 2*b*, membrane 2 has an arcuate part 21, wherein the angle of the portion of a circle is substantially equal to 180° from second edge portion 20 to a straight part 22 that connects to first edge portion 23. In FIG. 2*c*, membrane 2 has an arcuate part 21, wherein the angle of the portion of a circle is substantially smaller than 180° from second edge portion 20 to a straight part 22 that connects to first edge portion 23.

The curvature of membrane 2 in its active region can also affect its stiffness and thus impact the reduction of the first vibration mode frequency under the effect of a force in direction Z, given the reduced dimensions, where membrane 2 is located.

Preferably the thickness of the membrane is substantially the same throughout membrane 2, for example a specific thickness which may be on the order of 80 μm and can be reduced to a thickness on the order of 37 μm to lower the first vibration mode frequency to 500 Hz for a 5N gold membrane with a bezel connected to the crystal as indicated above. This has the advantage of working at a low frequency and obtaining a warmer, louder sound, since there are several radiated modes interpreted by the human ear as a loud sound, and a more distinct sound in the case of a set of notes produced to play a tune.

Figure 3:
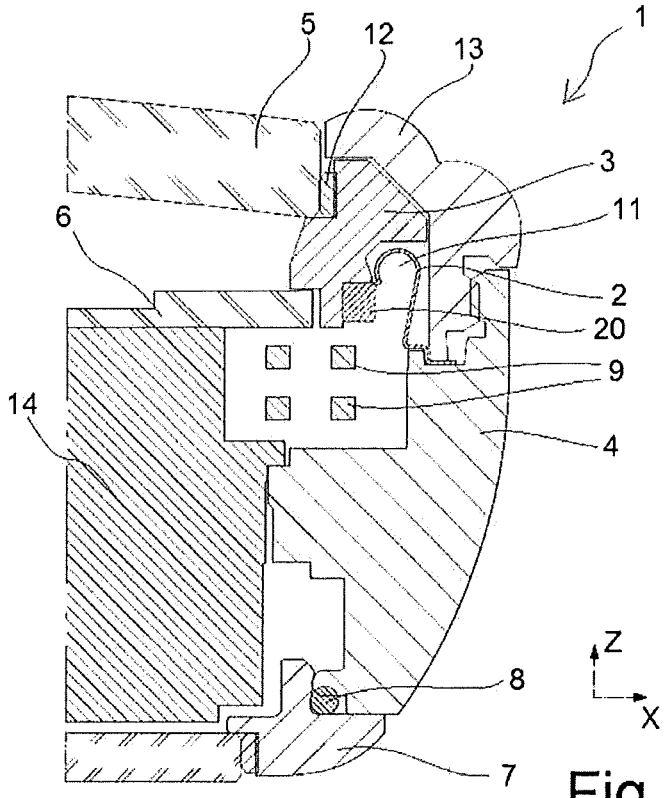
FIG. 3 represents a partial cross-sectional view of a striking or musical watch having a membrane in the vicinity of the crystal and the middle part of the watch case according to a second embodiment of the invention, and FIGS. 4*a* to 4*e* schematically represent different steps for making the membrane, shown in cross-section, of the second embodiment of the invention.

FIG. 3 represents a partial cross-sectional view of a striking or musical watch having a membrane in the vicinity of the crystal and the middle part of the watch case according to a second embodiment of the invention. The only difference in this second embodiment concerns the second edge portion 20 of membrane 2. This second edge portion includes a heel 20 used to start manufacture of the membrane by electroforming. Once membrane 2 is made with its second edge portion heel 20, this heel, which is an annular gold ring for example, can be directly pressed onto an external cylindrical wall of the bottom of bezel 3. This therefore makes it possible to obtain a one-piece membrane 2 and securing heel 20.

A method for manufacturing the membrane which, once finished, is mounted inside the striking watch, will be explained below. To this end, reference will be made to FIGS. 4*a* to 4*e*.

Figure 4A:
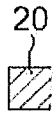

In FIG. 4*a*, a metal ring of annular shape 20 is provided. Preferably, this annular ring 20 can be made of 5N gold although other metal materials may be envisaged.

Figure 4B:
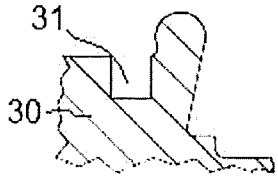

In FIG. 4*b*, a profile-turned substrate 30 is made as a base for making the membrane by electroforming. This substrate has a complementary profile to the shape of the membrane to be made. The substrate must be capable of dissolving at the end of the membrane manufacturing process without damaging the membrane. The substrate has an annular cavity 31 having the dimensions of the annular ring.

Figure 4C:
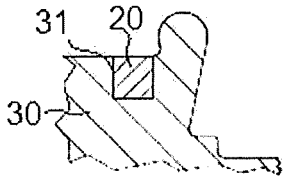

In FIG. 4*c*, annular ring 20 is pressed into annular cavity 31 of substrate 30. This annular ring is at the mouth of the cavity and will act as the starting point for forming the membrane.

Figure 4D:
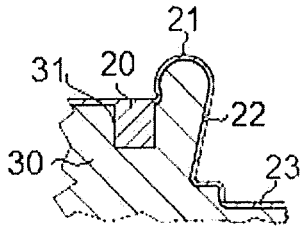

In FIG. 4*d*, the membrane is made starting from heel 20 and on complementary-shaped substrate 30 by electroforming with a metal material such as 5N gold. Depending on the shape of the substrate, the membrane is formed with its annular arcuate part 21, its straight part 22 and first edge portion 23. The second edge portion is directly connected to heel 20.

Figure 4E:
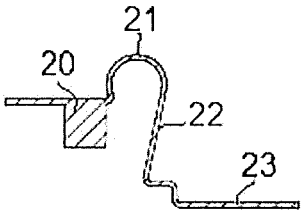

Finally, in FIG. 4*e*, the substrate is dissolved so that only the membrane with its portions 20 to 23 remain. Refining can also be provided by dipping the membrane into an electroforming bath to finish the part, particularly to refine its thickness. Subsequently, the membrane can be secured in the striking watch, particularly between the movable bezel and the case middle.

From the description that has just been given, several variants of the musical or striking watch provided with the acoustic radiating membrane can be devised by those skilled in the art without departing from the scope of the invention defined by the claims. The membrane could be made by an electroforming process with a metal other than gold.

The invention claimed is:

1. A striking or musical watch provided with at least one acoustic radiating membrane made of metallic material or amorphous metal, said membrane taking the form of a loop with walls of a specific thickness to be connected by a first edge portion to a middle part of a watch case and by a second edge portion to a bezel secured to a watch crystal, or directly to a watch crystal, the bezel connected to the crystal or the crystal being movable with respect to the case middle via the membrane during vibration of the membrane once a sound is generated by the watch striking mechanism in the watch case, wherein the membrane is configured with a wall of a specific thickness in an active region dependent on the mass of the bezel connected to the crystal, or only of the crystal, to obtain a frequency $f_0$ of a first vibration mode, which is on a low frequency of less than or equal to 4 kHz according to the equation $f_0=(1/2\pi)\cdot(k/m)^{1/2}$ where k is the stiffness of the membrane, which depends on the thickness thereof, and m is the mass of the bezel connected to the crystal, or only of the crystal.

2. The watch according to claim 1, wherein the membrane is annular in shape with an annular arcuate part starting from the second edge portion and pointing in a direction of the crystal perpendicular to the plane of the watch, the arcuate part being extended by a straight part, which is connected to the first edge portion.

3. The watch according to claim 2, wherein the annular arcuate part is a portion of a circle, on a cross-section, whose angle at rest is greater than 180°.

4. The watch according to claim 2, wherein the annular arcuate part is a portion of a circle, on a cross-section, whose angle at rest is substantially equal to 180°.

5. The watch according to claim 2, the annular arcuate part is a portion of a circle, on a cross-section, whose angle at rest is less than 180°.

6. The watch according to claim 2, the annular arcuate part and the straight part have the same thickness.

7. The watch according to claim 2, the straight part is of frustoconical shape.

8. The watch according to claim 2, the thickness of the membrane between the first edge portion and the second edge portion is less than or equal to 80 μm in order to obtain a frequency $f_0$ of a first vibration mode less than or equal to 1 kHz in a vibration mode in conjunction with the bezel or the crystal.

9. The watch according to claim 8, the thickness of the membrane between the first edge portion and the second edge portion is less than or equal to 40 μm in order to obtain a frequency $f_0$ of a first vibration mode on the order of 500 Hz in a vibration mode in conjunction with the bezel or the crystal.

10. The watch according to claim 1, the membrane is obtained by electroforming 5N gold in conjunction with the gold bezel.

11. The watch according to claim 1, the second edge portion of the membrane is secured by a securing ring, which is pressed or welded onto a cylindrical external wall of the bottom of the bezel.

12. The watch according to claim 1, the second edge portion includes a heel obtained during the manufacture by electroforming of the membrane, said heel being an annular ring for securing the membrane by press fit onto a cylindrical external wall of the bottom of the bezel.

13. The watch according to claim 1, the watch includes a complementary bezel disposed above the bezel and serving as protection, and for securing the first edge portion of the membrane to an upper part of the case middle.

14. A method for manufacturing a membrane for a striking or musical watch according to claim 1, the method includes the steps of:

providing a profile-turned substrate of complementary shape to the membrane to be made, making the membrane on the substrate by electroforming with a metallic material or amorphous metal, and dissolving the substrate to retain only the membrane with a first edge portion, a straight part, an arcuate part and a second edge portion obtained with a specific thickness.

15. The method for manufacturing a membrane for a striking or musical watch according to claim 1, the method includes the steps of:

providing an annular ring made of metal or amorphous metal, providing a profile-turned substrate of complementary shape to the membrane to be made and comprising an annular cavity having the shape of the annular ring, pressing the annular ring into the annular cavity of the substrate making the membrane from the heel on the substrate by electroforming with a metallic material or amorphous metal, and dissolving the substrate to retain only the membrane with a first edge portion, a straight part, an arcuate part and a second edge portion with the one-piece heel, the arcuate part and the straight part having the same specific thickness.

16. The method according to claim 14, the membrane with or without a heel is made of 5N gold.

17. The method according to claim 15, the membrane with or without a heel is made of 5N gold.

* * * * *